US011251565B2

(12) United States Patent
Nozaki

(10) Patent No.: US 11,251,565 B2
(45) Date of Patent: Feb. 15, 2022

(54) LEVER-TYPE CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Shinji Nozaki, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/258,426

(22) PCT Filed: Jun. 27, 2019

(86) PCT No.: PCT/JP2019/025540
§ 371 (c)(1),
(2) Date: Jan. 6, 2021

(87) PCT Pub. No.: WO2020/017271
PCT Pub. Date: Jan. 23, 2020

(65) Prior Publication Data

US 2021/0273377 A1 Sep. 2, 2021

(30) Foreign Application Priority Data

Jul. 17, 2018 (JP) ..... JP2018-133941

(51) Int. Cl.
*H01R 13/629* (2006.01)

(52) U.S. Cl.
CPC ..... *H01R 13/62938* (2013.01)

(58) Field of Classification Search
CPC ..... H01R 13/62938
See application file for complete search history.

(56) References Cited

U.S. PATENT DOCUMENTS 7,670,157 B2 * 3/2010 Miyamoto ..... H01R 13/62938 439/157
7,959,451 B2 * 6/2011 Tonosaki ..... H01R 13/62938 439/157

(Continued)

FOREIGN PATENT DOCUMENTS

JP 2002-231379 A 8/2002
JP 2009-277487 A 11/2009

OTHER PUBLICATIONS

International Search Report dated Aug. 27, 2019 for WO 2020/017271 A1 (2 pages).

*Primary Examiner* — Vanessa Girardi
(74) *Attorney, Agent, or Firm* — Abelman, Frayne & Schwab

(57) ABSTRACT

A lever-type connector includes a first housing, a second housing, and a lever for moving the second housing. The lever is formed with cam grooves and the second housing includes cam followers movable along the cam grooves. The lever is rotatable about axes of rotation movable within a predetermined range with respect to the first housing. The cam groove includes a first groove portion configured to guide the cam follower, a second groove portion disposed along the first groove portion on the side of the axes of rotation with respect to the first groove portion and configured to guide the cam follower, and a coupling groove extending in a direction intersecting the first and second groove portions to couple the first and second groove portions and configured to guide the cam follower. The coupling groove extends in a direction along a moving direction of the axes of rotation.

4 Claims, 23 Drawing Sheets

(56) References Cited

U.S. PATENT DOCUMENTS

| | | | | |
|---|---|---|---|---|
| 9,130,324 | B2 * | 9/2015 | Furuya | H01R 24/005 |
| 2014/0349499 | A1 | 11/2014 | Takatsu | |

* cited by examiner

LEVER-TYPE CONNECTOR

CROSS REFERENCE TO RELATED APPLICATIONS

This application is a national phase of PCT application No. PCT/JP2019/025540, filed on 27 Jun. 2019, which claims priority from Japanese patent application No. 2018-133941, filed on 17 Jul. 2018, all of which are incorporated herein by reference.

TECHNICAL FIELD

A technique relating to a lever-type connector is disclosed in this specification.

BACKGROUND

Conventionally, a connector is known in which male and female connector housings can be connected with a low connection force by operating a lever in connecting the connector housings. In Patent Document 1, a lever mounted on the outer surface of a female connector housing is formed with a first shaft hole and a second shaft hole communicating with each other and a cam groove. The cam groove is formed into a chevron shape by connecting a cam groove for forward rotation and a cam groove for reverse rotation via a transition portion. If the lever is rotated in a forward rotation direction with a support shaft of the female connector housing held in the first shaft hole, the cam groove for forward rotation guides a cam follower provided on a male connector housing to connect the both connector housings halfway. Thereafter, if the support shaft is moved to the second shaft hole and the lever is rotated in a reverse rotation direction, the cam groove for reverse rotation guides the cam follower and the male and female connector housings are completely connected.

PRIOR ART DOCUMENT

Patent Document

Patent Document 1: JP 2009-277487 A

SUMMARY OF THE INVENTION

Problems to be Solved

Since a direction of the transition portion connecting the cam groove for forward rotation and the cam groove for reverse rotation is different from a direction from a first position to a second position in the shaft holes in the configuration of the above Patent Document 1, an operator needs to adjust an angle of the lever. Thus, there has been a problem that the operation of the lever to completely connect the male and female connector housings is not easy.

The technique disclosed in this specification was completed on the basis of the above situation and aims to provide a lever-type connector enabling easy operation of a lever in connecting housings.

Means to Solve the Problem

A lever-type connector described in this specification is provided with a first housing, a second housing to be connected to the first housing, and a lever for moving the second housing in a connection direction to the first housing by being rotated with respect to the first housing, wherein the lever is formed with a cam groove and the second housing is formed with a cam follower movable along the cam groove, the lever is rotatable about an axis of rotation movable within a predetermined range with respect to the first housing, the cam groove includes a first groove portion configured to guide the cam follower, a second groove portion disposed along the first groove portion on the axis of rotation side with respect to the first groove portion and configured to guide the cam follower, and a coupling groove extending in a direction intersecting the first and second groove portions to couple the first and second groove portions and configured to guide the cam follower, and the coupling groove extends in a direction along a moving direction of the axis of rotation.

According to this configuration, if the lever is rotated with the cam follower disposed in the first groove portion, the cam follower is guided in the first groove portion. If the cam follower reaches a position where the first groove portion and the coupling groove intersect, the first and second housings are partially connected. Thereafter, if the lever is slid with respect to the first housing, the cam follower in the first groove portion moves to the second groove portion through the coupling portion and the cam follower reaches a position where the coupling groove and the second groove portion intersect, thereby restricting a sliding movement of the lever, as the axis of rotation of the lever moves. By rotating the lever toward an opposite side, the cam follower in the second groove portion moves to an opposite side of the second groove portion and the first and second housings are completely connected. In this way, the lever can be easily operated in completely connecting the first and second housings in a partially connected state.

The following modes are preferable as embodiments of the technique described in this specification.

The first housing is formed with a support shaft concentric with the axis of rotation, the lever is formed with a first shaft hole and a second shaft hole, the support shaft being rotatably inserted into the first and second shaft holes, and a partitioning portion partitioning between the first and second shaft holes, and the partitioning portion is deflectable and deformable in a direction to allow a movement of the support shaft between the first and second shaft holes.

If this configuration is employed, the lever can be rotatably held at a plurality of axes of rotation by the partitioning portion.

A contact portion for coming into contact with the partitioning portion to deflect and deform the partitioning portion by rotation of the lever projects on an outer periphery of the support shaft.

If this configuration is employed, the partitioning portion can be deflected and deformed by the contact portion during the rotation of the lever.

A coupling portion is provided which couples the first and second groove portions, the first and second groove portions are formed to penetrate through the lever, and the coupling groove is provided on the first housing side of the coupling portion.

If this configuration is employed, the strength of a region between the first and second groove portions can be enhanced as compared to the case where the coupling groove is formed to penetrate through the lever.

Effect of the Invention

According to the technique described in this specification, it is possible to facilitate the operation of a lever in connecting housings of a lever-type connector.

DETAILED DESCRIPTION TO EXECUTE THE INVENTION

Embodiment

A lever-type connector 10 of an embodiment is described with reference to FIGS. 1 to 23. Although the lever-type connector 10 can be used in an arbitrary orientation, an X direction and a Y direction of FIG. 2 and a Z direction of FIG. 1 are referred to as a forward direction, a leftward direction and an upward direction in the following description for the convenience of description.

Figure 1:
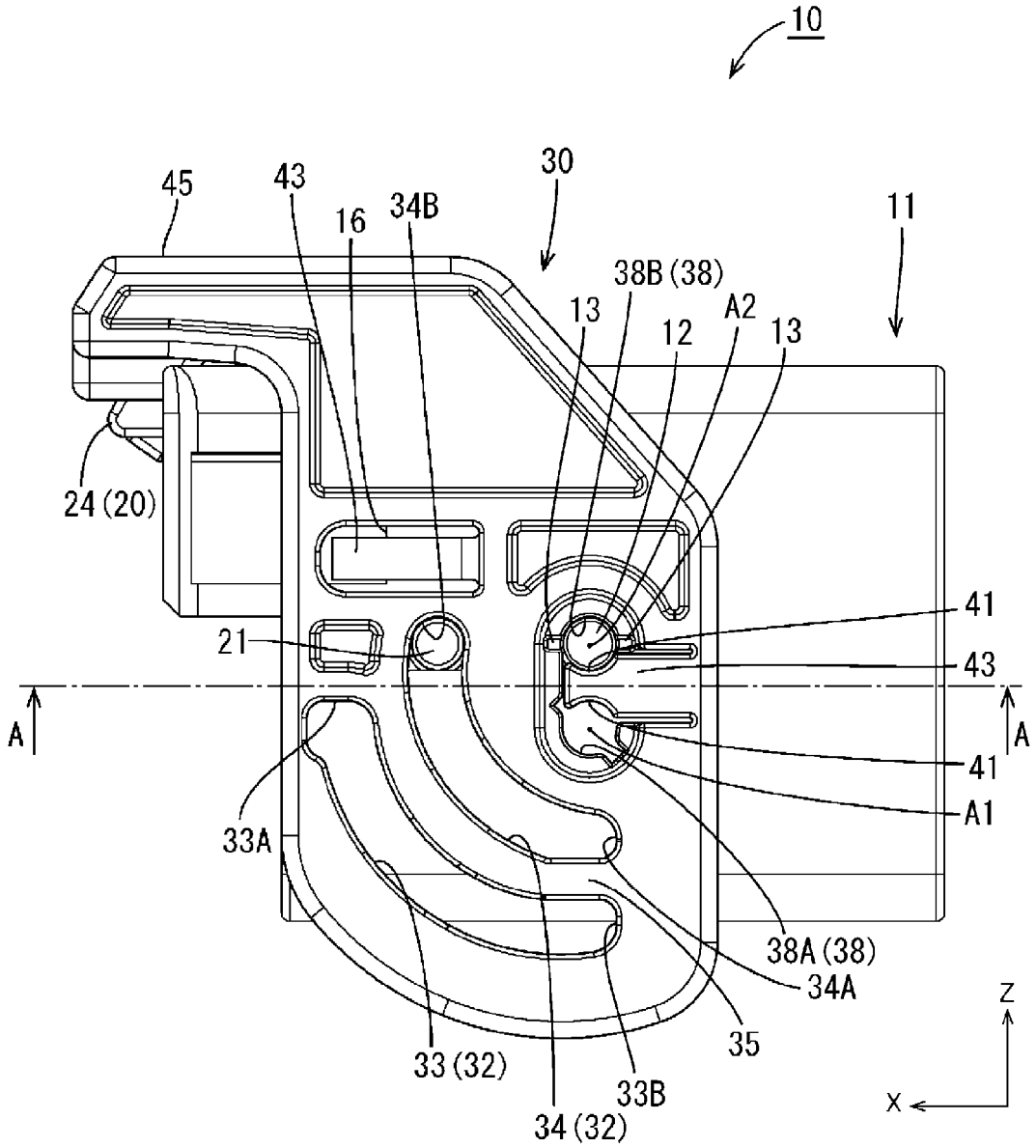
FIG. 1 is a side view showing a lever-type connector in which a first housing and a second housing are completely connected in an embodiment.
Figure 2:
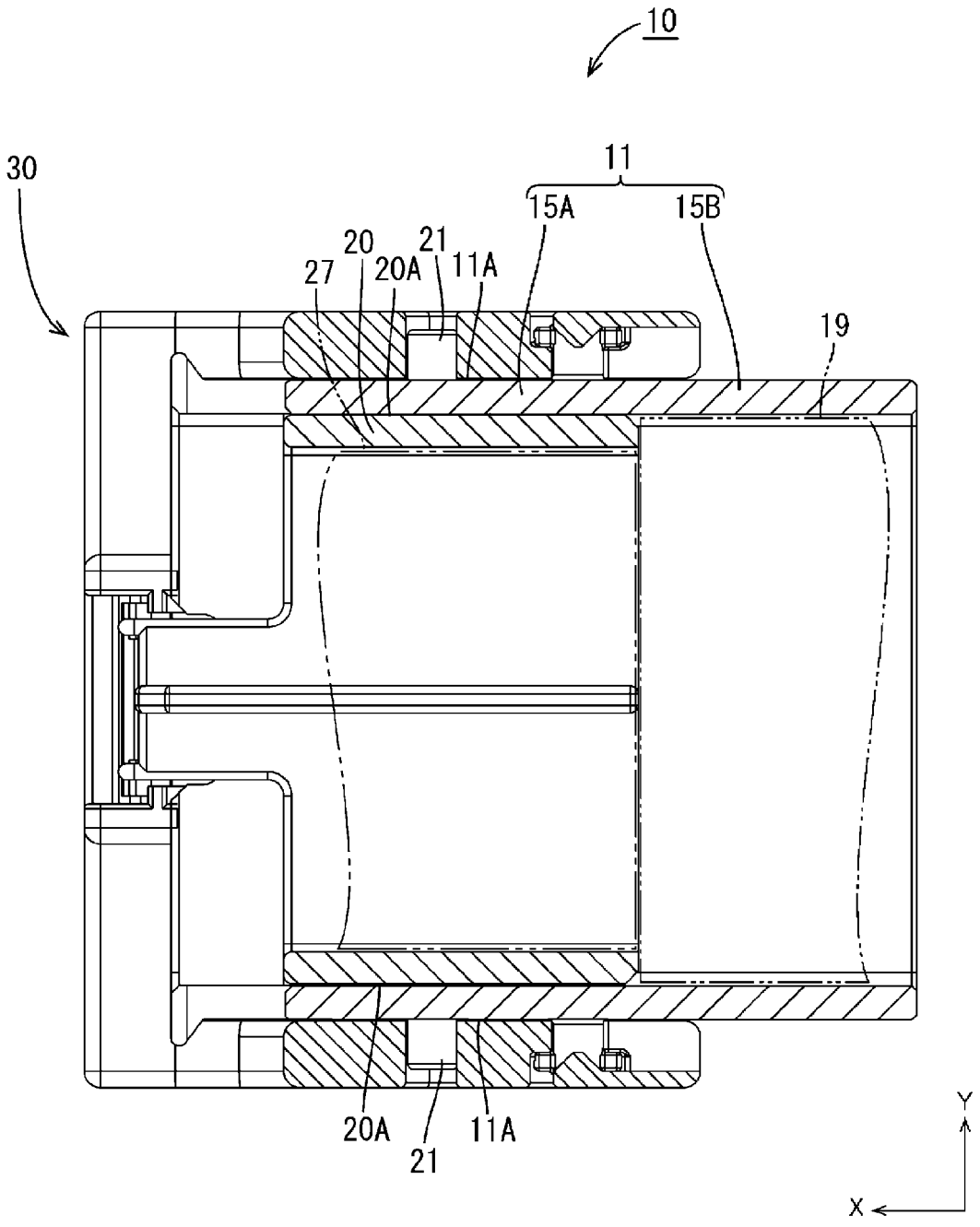
FIG. 2 is a section along A-A of FIG. 1.
Figure 3:
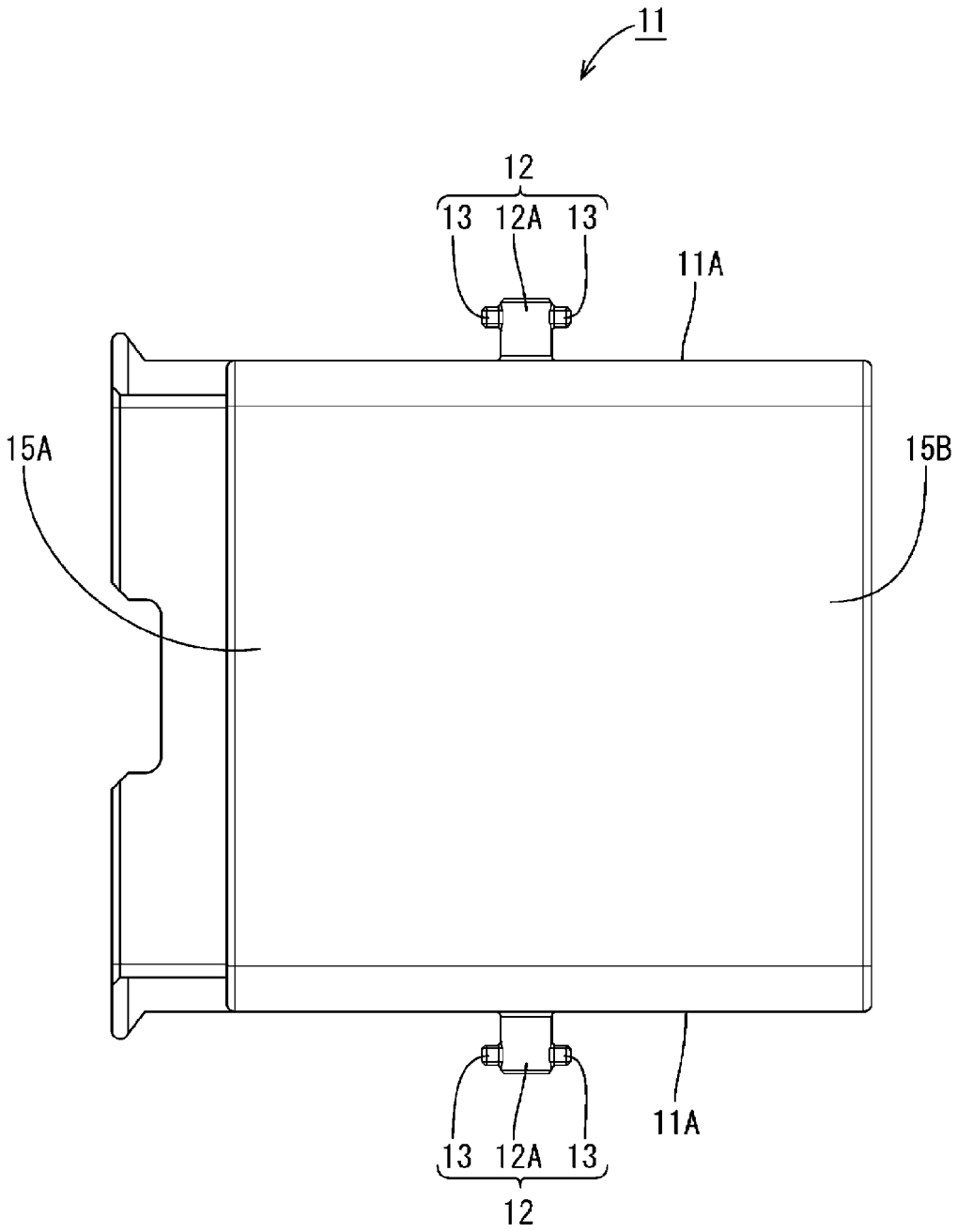
FIG. 3 is a plan view showing the first housing.

As shown in FIGS. 1 and 2, the lever-type connector 10 includes a first housing 11 made of synthetic resin, a second housing 20 made of synthetic resin and to be connected to the first housing 11, and a lever 30 made of synthetic resin and rotatable by an operator. As shown in FIG. 2, the first housing 11 is in the form of a rectangular tube, a front side serves as a receptacle 15A into which the second housing 20 is fittable, and a rear side serves as a body tube portion 15B into which a first terminal holding portion 19 serving as an inner housing is fit. The first terminal holding portion 19 is, for example, such that female terminals (not shown) are held at predetermined positions in a housing made of synthetic resin, and is fixed to the body tube portion 15B by a fixing means (not shown).

Figure 4:
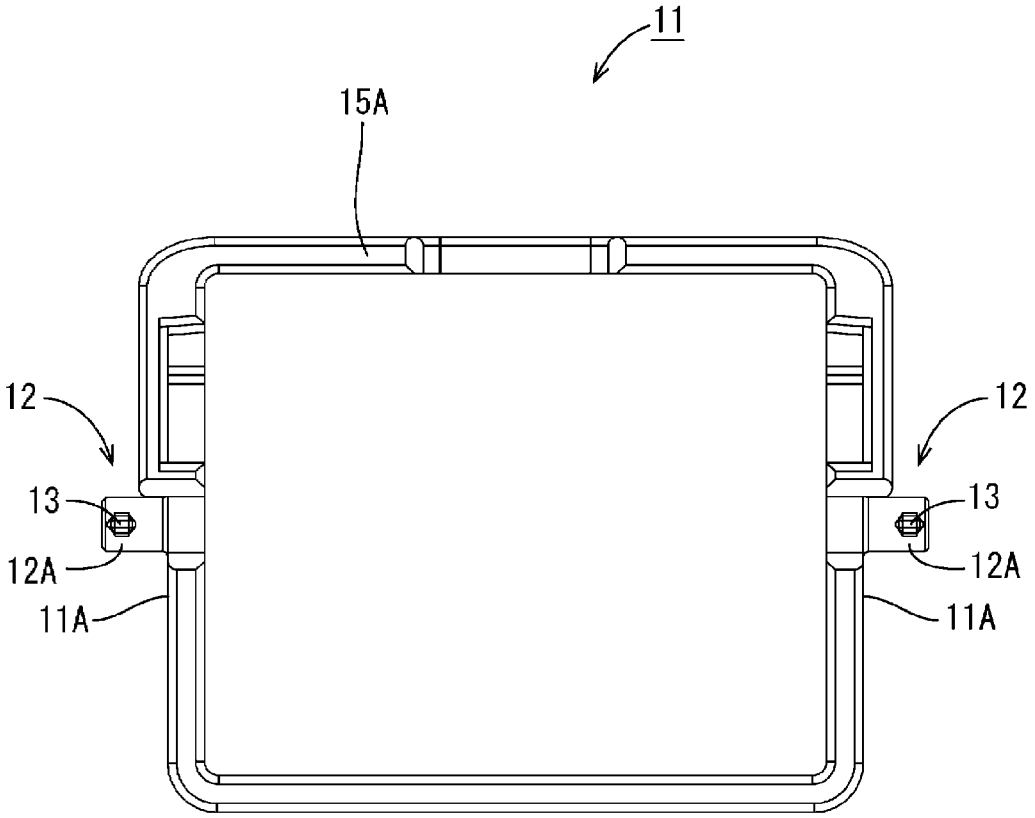
FIG. 4 is a front view showing the first housing.
Figure 5:
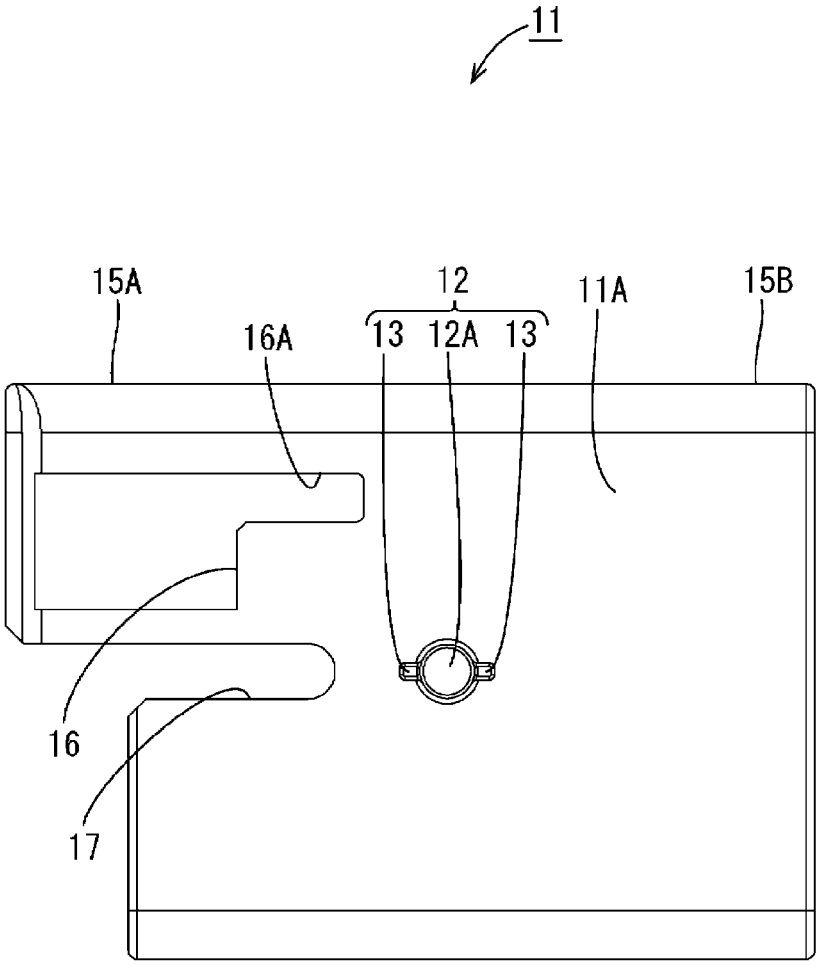
FIG. 5 is a side view showing the first housing.
Figure 6:
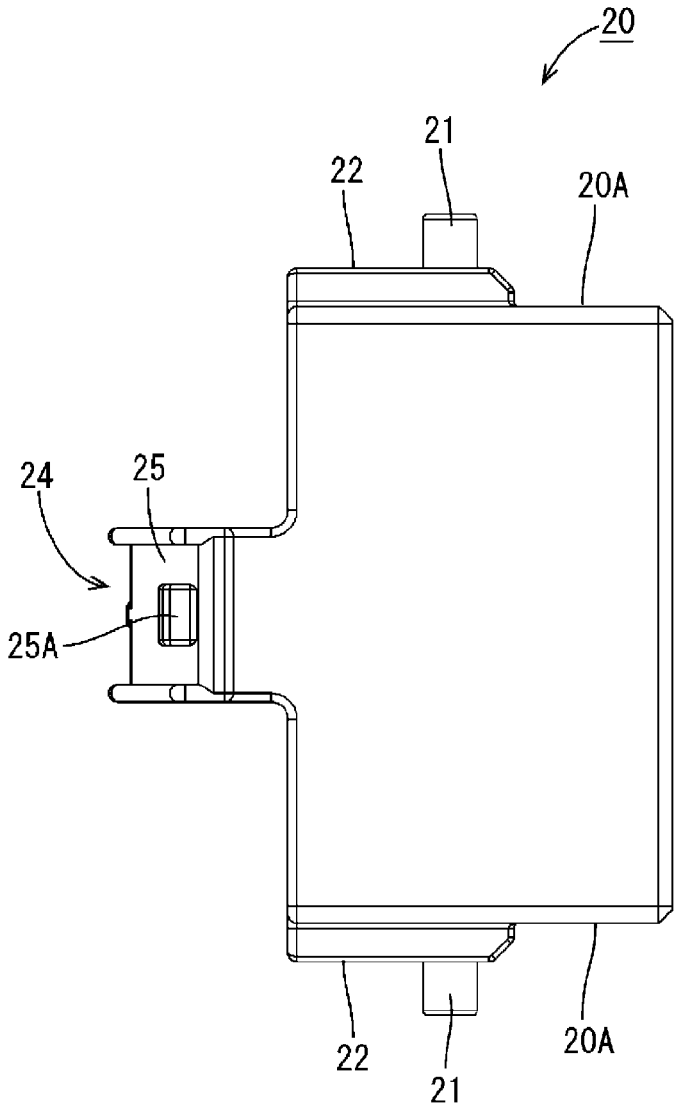
FIG. 6 is a plan view showing the second housing.

As shown in FIGS. 4 and 5, a pair of support shafts 12 project on the outer surfaces of left and right side walls 11A of the first housing 11. Each support shaft 12 is provided in a central part of the outer surface of the side wall 11A and includes a cylindrical support shaft body 12A and a pair of contact portions 13, 13 projecting on the outer peripheral surface of the support shaft body 12A. The respective contact portions 13 are in the form of rods cut to have a tapered tip part, are provided at a predetermined height position of the support shaft body 12A from the outer surface of the side wall 11A, project in a radial direction of the support shaft body 12A and are provided at positions symmetric with each other with respect to an axis center of the support shaft body 12A (180° opposite positions).

The receptacle 15A is formed into such a shape that an upper side of the first housing 11 protrudes forward. As shown in FIG. 5, the receptacle 15A is provided with penetrating cutout portions 16 by cutting the side walls 11A. A rear side of the cutout portion 16 is reduced in width in a stepped manner and serves as a narrow portion 16A linearly extending in a front-rear direction. An insertion groove 17 into which a cam follower 21 is inserted extends in the front-rear direction below the cutout portion 16. The insertion groove 17 linearly extends from a position forward of the support shaft 12 by a predetermined dimension to the front end of the first housing 11. The terminals held in the first terminal holding portion 19 are, for example, female terminals. Note that although the first terminal holding portion 19 is the inner housing, there is no limitation to this and a first housing may be integrally formed with the first terminal holding portion 19.

As shown in FIG. 2, the second housing 20 is in the form of a rectangular tube, and a second terminal holding portion 27 serving as an inner housing is accommodated inside. The second terminal holding portion 27 is made of synthetic resin, holds, for example, male terminals (not shown) at predetermined positions, and is fixed to the second housing 20 by a fixing means (not shown). Note that although the second terminal holding portion 27 is the inner housing, there is no limitation to this and a second housing may be integrally formed with the second terminal holding portion 27.

Figure 7:
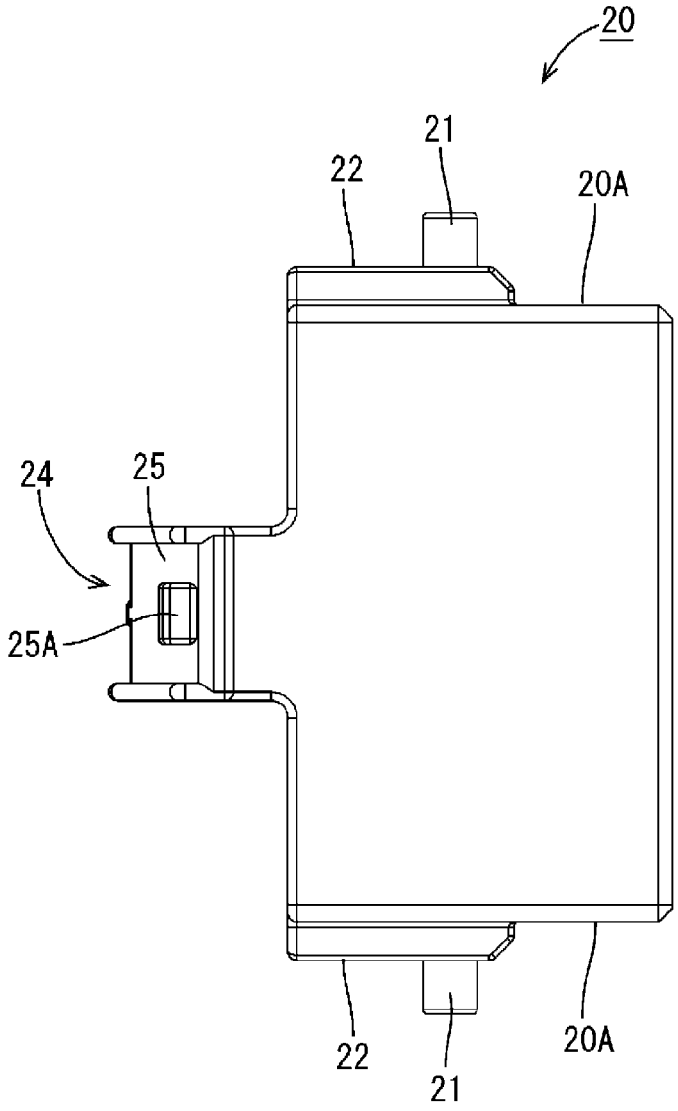
FIG. 7 is a front view showing the second housing.
Figure 8:
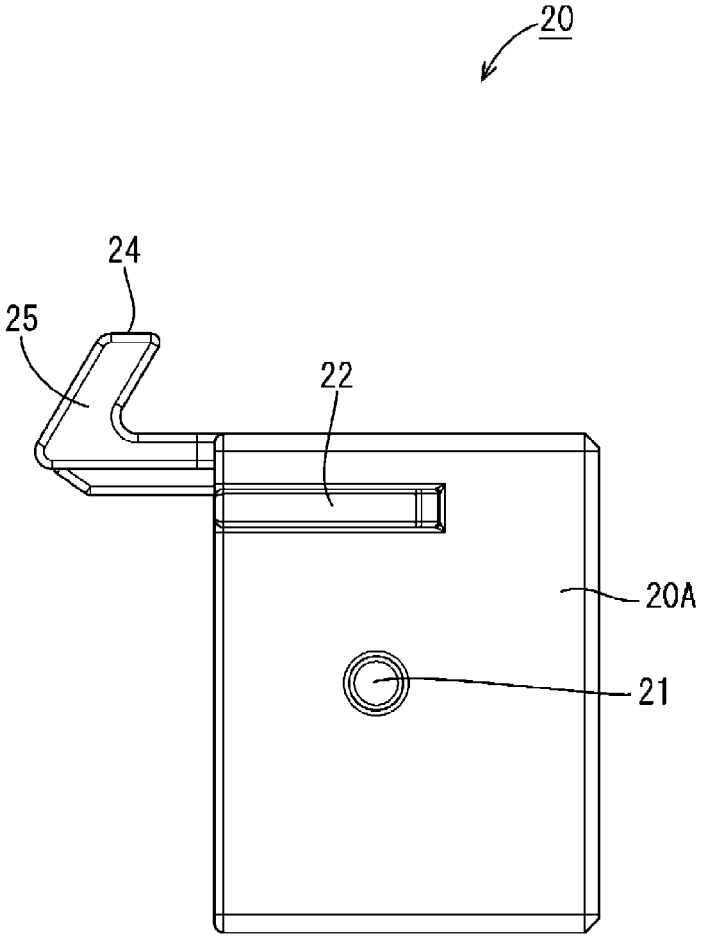
FIG. 8 is a side view showing the second housing.

As shown in FIGS. 7 and 8, a pair of the cam followers 21 project on the outer surfaces of left and right side walls 20A of the second housing 20. The pair of cam followers 21 have both a cylindrical shape and are provided in central parts of the outer surfaces of the side walls 20A. A ridge 22 extending in the front-rear direction is formed in an upper part of the outer surface of the side wall 20A. The ridge 22 is inserted into the narrow portion 16A of the cutout portion 16 in the first housing 11, and guides a moving direction of the second housing 20 with respect to the first housing 11 while restricting the separation of the second housing 20 from the first housing 11.

A lever locking portion 24 for restricting the rotation of the lever 30 by locking the lever 30 is formed atop the second housing 20. The lever locking portion 24 is hook-shaped, and a locking projection 25A for locking the lever 30 is formed on a standing portion 25 standing obliquely to the upper surface of the second housing 20.

Figure 9:
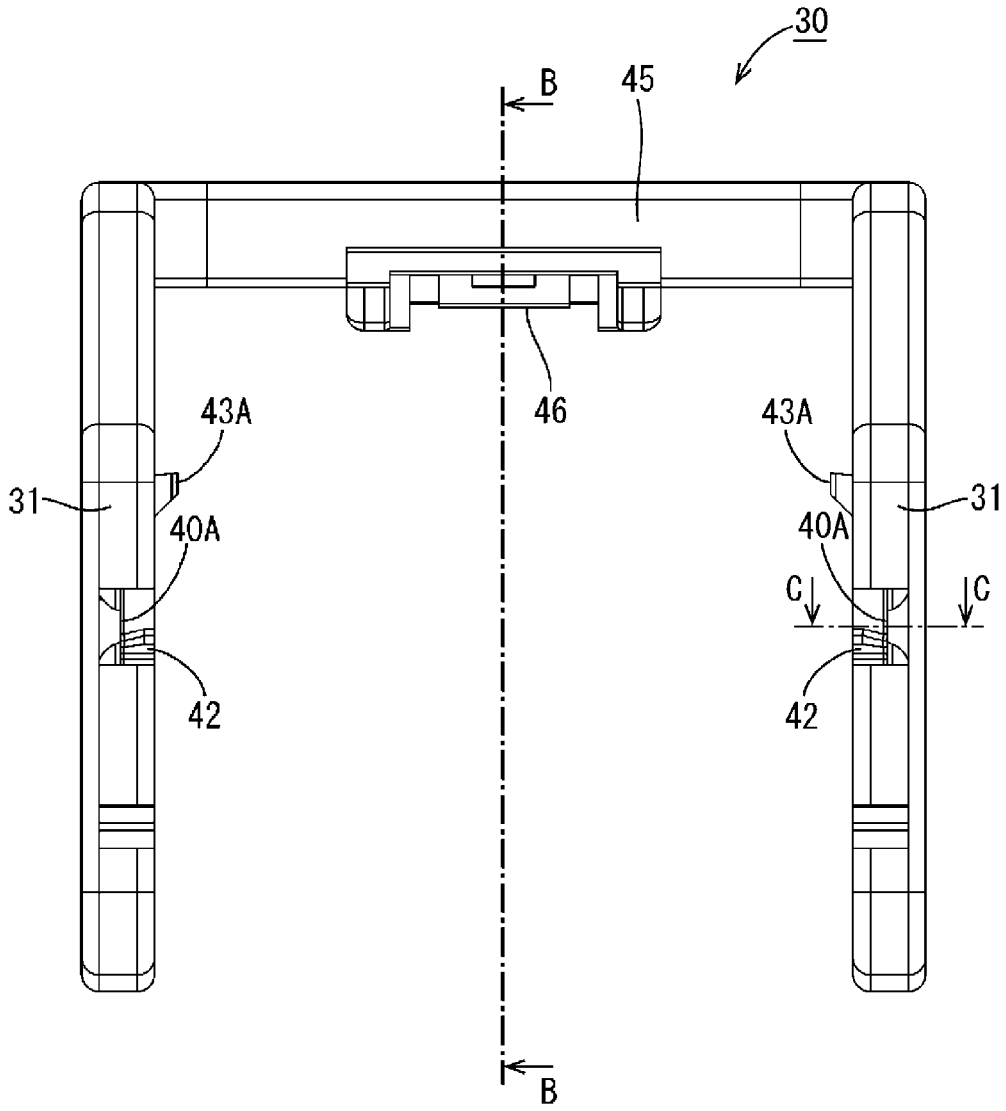
FIG. 9 is a back view showing a lever.
Figure 10:
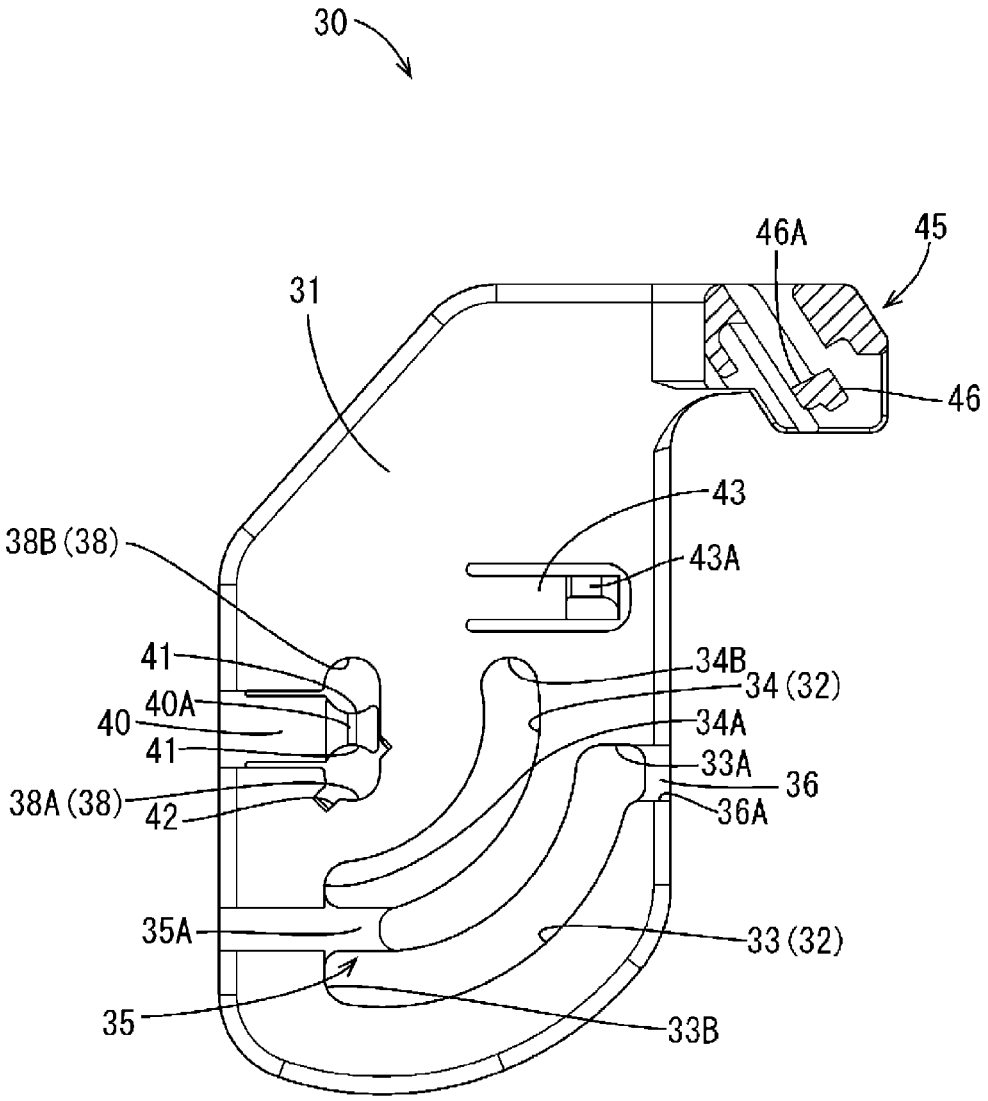
FIG. 10 is a section along B-B of FIG. 9.

As shown in FIG. 9, the lever 30 includes a pair of facing plates 31, 31 facing the both side walls 11A of the first housing 11 and a coupling grip portion 45 coupling the pair of facing plates 31, 31 and operable by being gripped by an operator. As shown in FIG. 10, each facing plate 31 is formed with a cam groove 32 into which the cam follower 21 is inserted, a shaft hole 38 into which the support shaft 12 is inserted, and a locking piece 43 lockable to the cutout portion 16 of the first housing 11.

The cam groove 32 includes a first groove portion 33 configured to guide a movement of the cam follower 21, a second groove portion 34 arranged along the first groove portion 33 and configured to guide a movement of the cam follower 21, and a coupling portion 35 coupling an end part 33B of the first groove portion 33 and an end part 34A of the second groove portion 34. The first and second groove portions 33, 34 are through holes extending in an arcuate manner while having a substantially constant width. The second groove portion 34 is disposed inward of (on the side of the shaft hole 38) and at a predetermined distance from the first groove portion 33, and a final end part 34B of the second groove portion 34 is formed above a starting end part 33A of the first groove portion 33.

The starting end part 33A of the first groove portion 33 is formed with an introduction groove 36A extending in a direction intersecting the first groove portion 33. The introduction groove 36A can guide the cam follower 21 introduced from outside, and is covered by an introduction cover portion 36. The coupling portion 35 is formed with a coupling groove 35A into which the cam follower 21 is insertable. The coupling groove 35A is formed in a surface of the coupling portion 35 on the side of the first housing 11 and forms a space, in which the cam follower 21 is movable, in a path between the end part 33B of the groove portion 33 and the end part 34A of the groove portion 34.

The shaft hole 38 has an elliptical shape long in a coupling direction (vertical direction of FIG. 10) of the coupling portion 35 (and the coupling groove 35A) and is partitioned by a tip part of a partition piece 40 (an example of a "partitioning portion") for partitioning a longitudinal intermediate part. The partition piece 40 is in the form of a deflectable and deformable plate cantilevered from a side edge part of each facing plate 31, and both side surfaces of the tip part of the partition piece 40 are formed into concave surfaces 41 cut in an arcuate manner along the outer peripheral surface of the support shaft 12.

Figure 11:
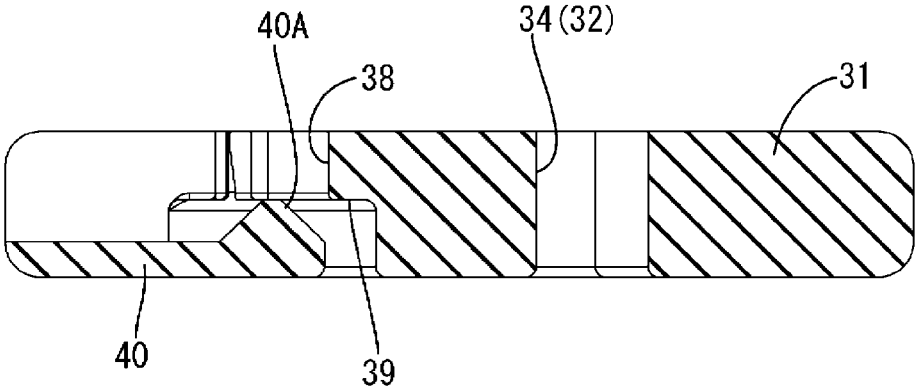
FIG. 11 is a section along C-C of FIG. 9.
Figure 12:
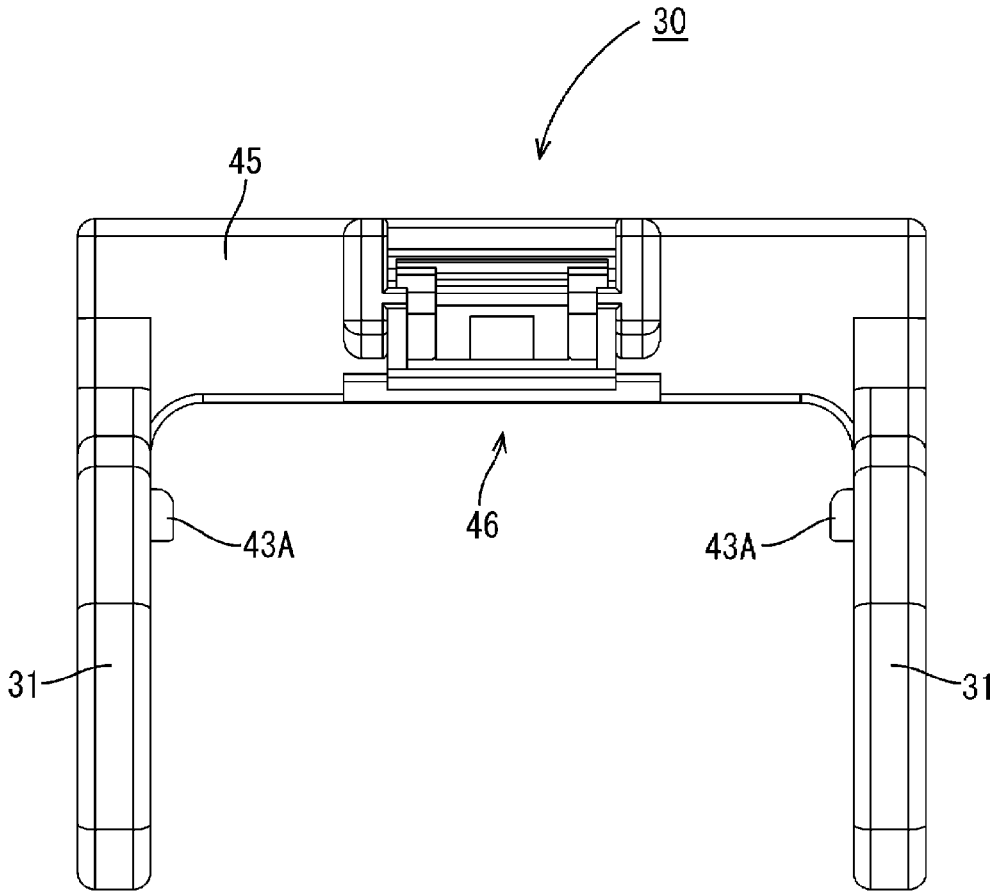
FIG. 12 is a bottom view showing the lever.

The shaft hole 38 partitioned by the partition piece 40 includes a first shaft hole 38A having an axis of rotation A1 at an axis center of the support shaft 12 inserted thereinto, and a second shaft hole 38B having an axis of rotation A2 at the axis center of the support shaft 12 inserted thereinto. A chevron-shaped projection 40A is formed on a surface of the partition piece 40 on the side of the first housing 11. If the lever 30 is rotated, the contact portions 13 and the support shaft bodies 12A of the support shafts 12 come into contact with the projections 40A of the partition pieces 40 to resiliently deform the partition pieces 40. Note that the shaft hole 38 is formed with assembly grooves 42 into which the contact portions 13 are inserted when the lever 30 is assembled, and a hole edge of the shaft hole 38 on the outer surface side of the facing plate 31 is provided with a recess 39 forming a space for allowing the passage (rotation) of the contact portions 13 as shown in FIG. 11.

As shown in FIG. 10, the locking piece 43 is in the form of a resiliently deflectable plate, and a locking claw 43A projecting toward the first housing 11 is formed on a tip part. The locking claw 43A can restrict the rotation of the lever 30 by locking the cutout portion 16 of the first housing 11.

The coupling grip portion 45 is formed with a locking portion 46 for holding the lever 30 in a locked state by locking the locking projection 25A of the second housing 20. The locking portion 46 is frame-shaped and can hold the first housing 11 and the second housing 20 in a completely connected state by locking a hole edge of a locked hole 46A to the locking projection 25A of the second housing 20 to restrict the rotation of the lever 30.

Next, a rotating operation of the lever 30 is described.

Figure 13:
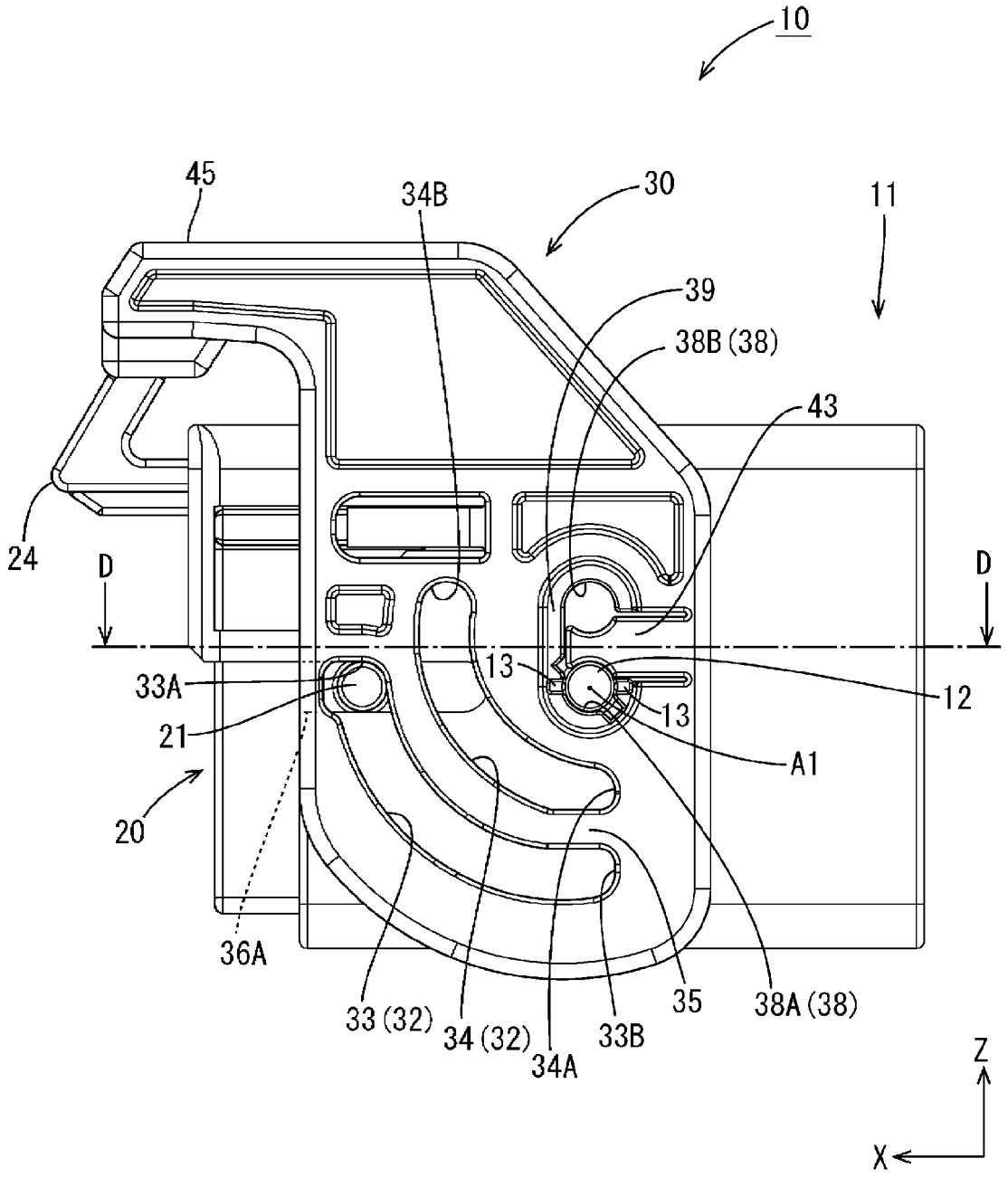
FIG. 13 is a side view showing the lever-type connector in an initial state.
Figure 14:
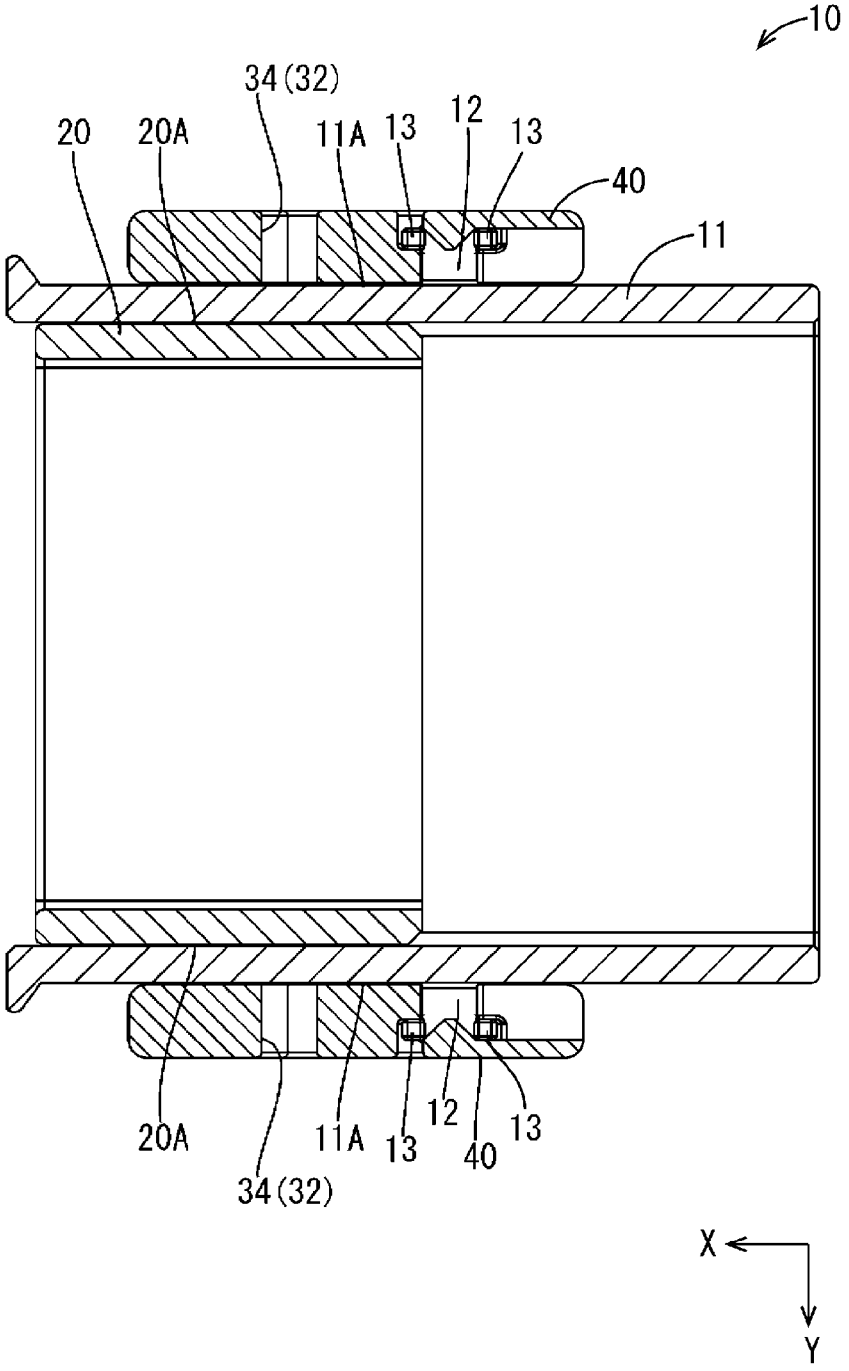
FIG. 14 is a section along D-D of FIG. 13.

As shown in FIG. 13, if the second housing 20 is connected to the first housing 11 while the cam followers 21 of the second housing 20 are inserted into front end sides of the introduction grooves 36A of the lever 30 disposed at an initial position (position of FIG. 13) of rotation with the support shafts 12 of the first housing 11 inserted in the first shaft holes 38A of the lever 30, the cam followers 21 are disposed in the starting end parts 33A of the first groove portions 33.

Figure 15:
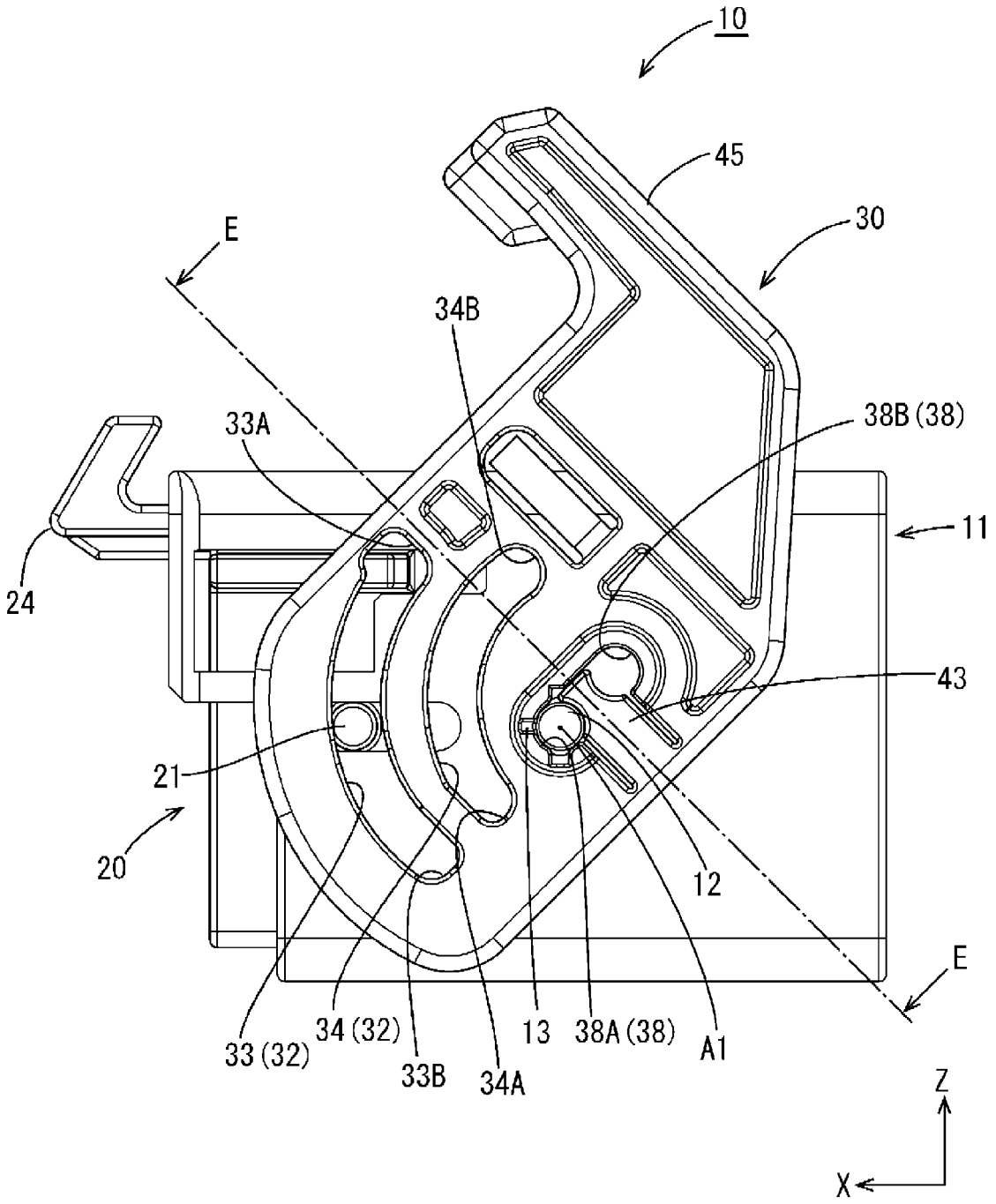
FIG. 15 is a side view of the lever-type connector showing a state where the lever is rotated 45° in a forward rotation direction from the state of FIG. 13.
Figure 16:
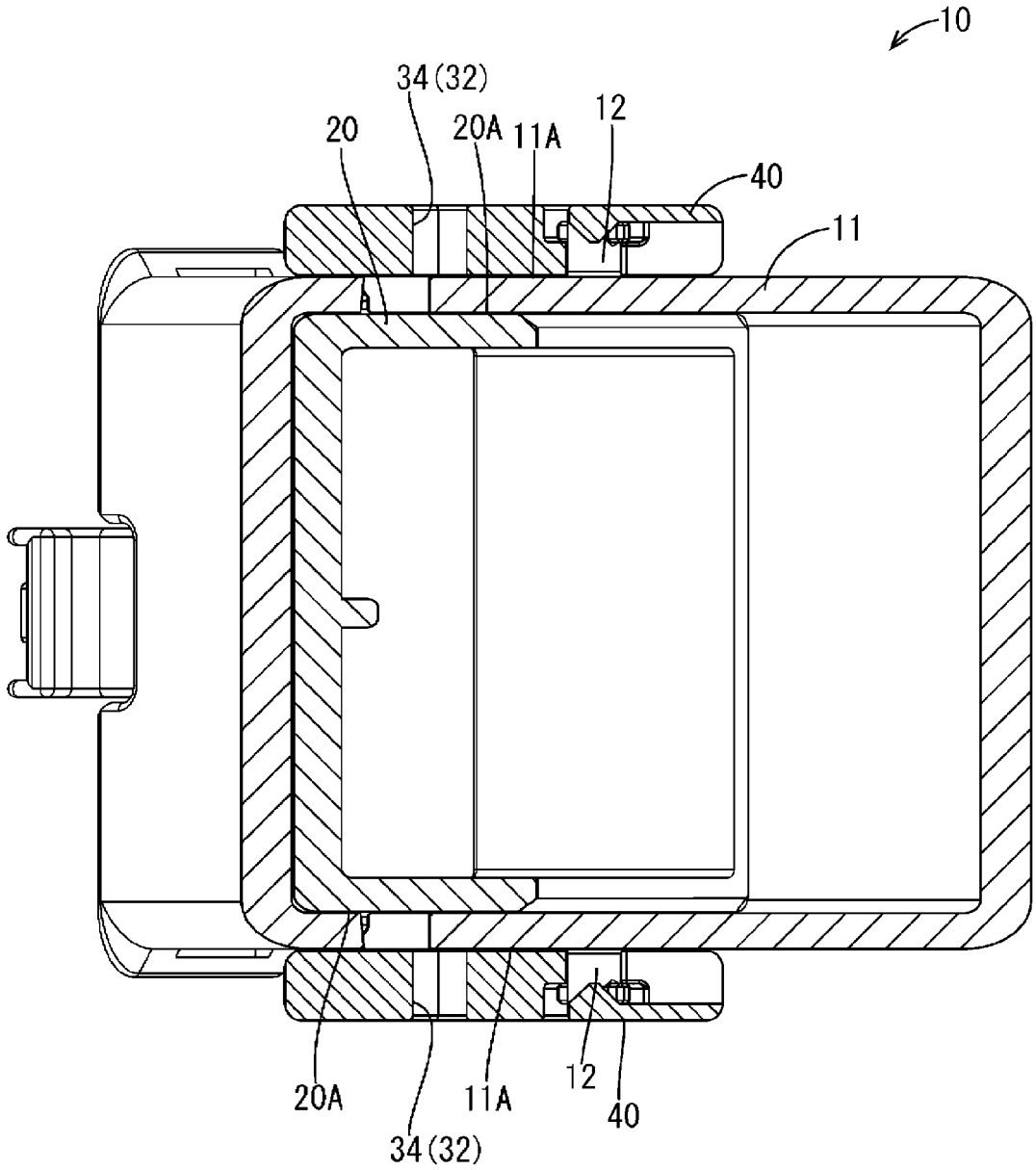
FIG. 16 is a section along E-E of FIG. 15.
Figure 17:
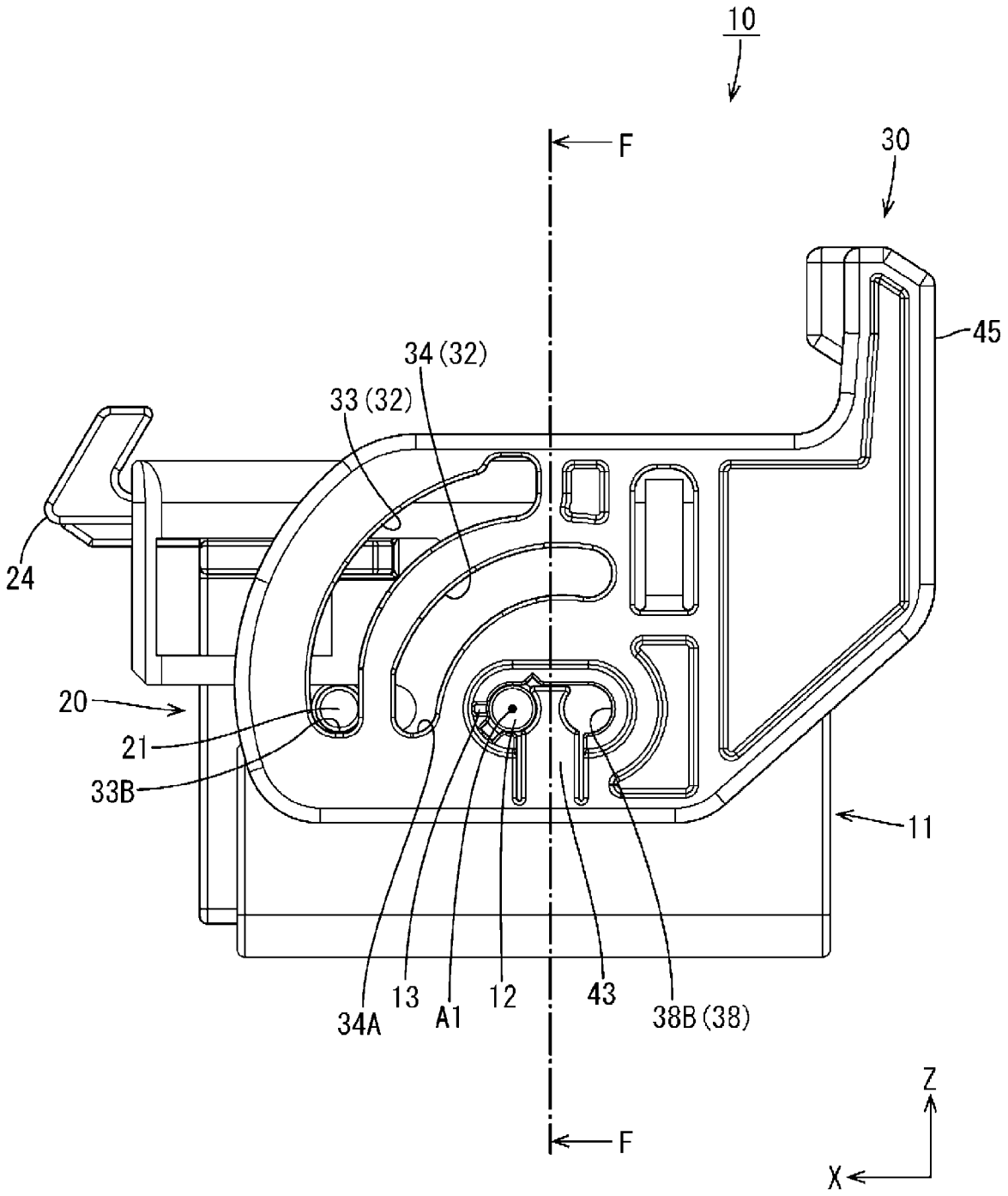
FIG. 17 is a side view of the lever-type connector in a partially connected state set by further rotating the lever 45° in the forward rotation direction from the state of FIG. 15.
Figure 18:
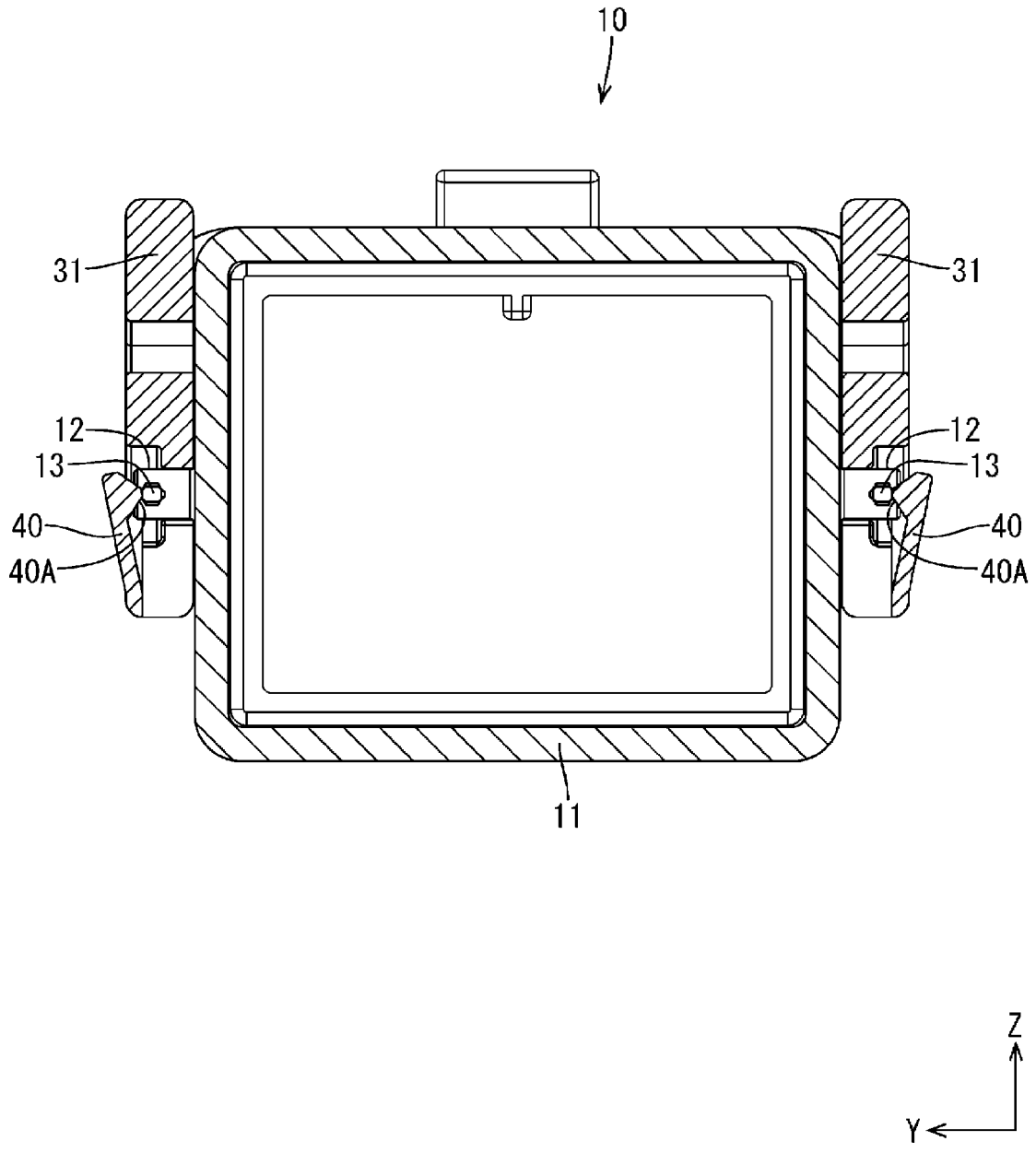
FIG. 18 is a section along F-F of FIG. 17.

Subsequently, the lever 30 is rotated in the forward rotation direction. Then, as shown in FIG. 15, the first shaft holes 38A rotate about the axes of rotation A1 with respect to the support shafts 12 and the cam followers 21 move toward the other end parts 33B in the first groove portions 33. Then, when the cam followers 21 reach the end parts 33B of the first groove portions 33 as shown in FIG. 17, the cam followers 21 are locked to the end parts 33B to restrict the rotation of the lever 30 in the forward rotation direction and the contact portions 13 of the support shafts 12 come into contact with the projections 40A of the partition pieces 40 to deflect and deform the partition pieces 40 outward as shown in FIG. 18, whereby the lever 30 can slide forward with respect to the first and the second housings 11, 20.

Figure 19:
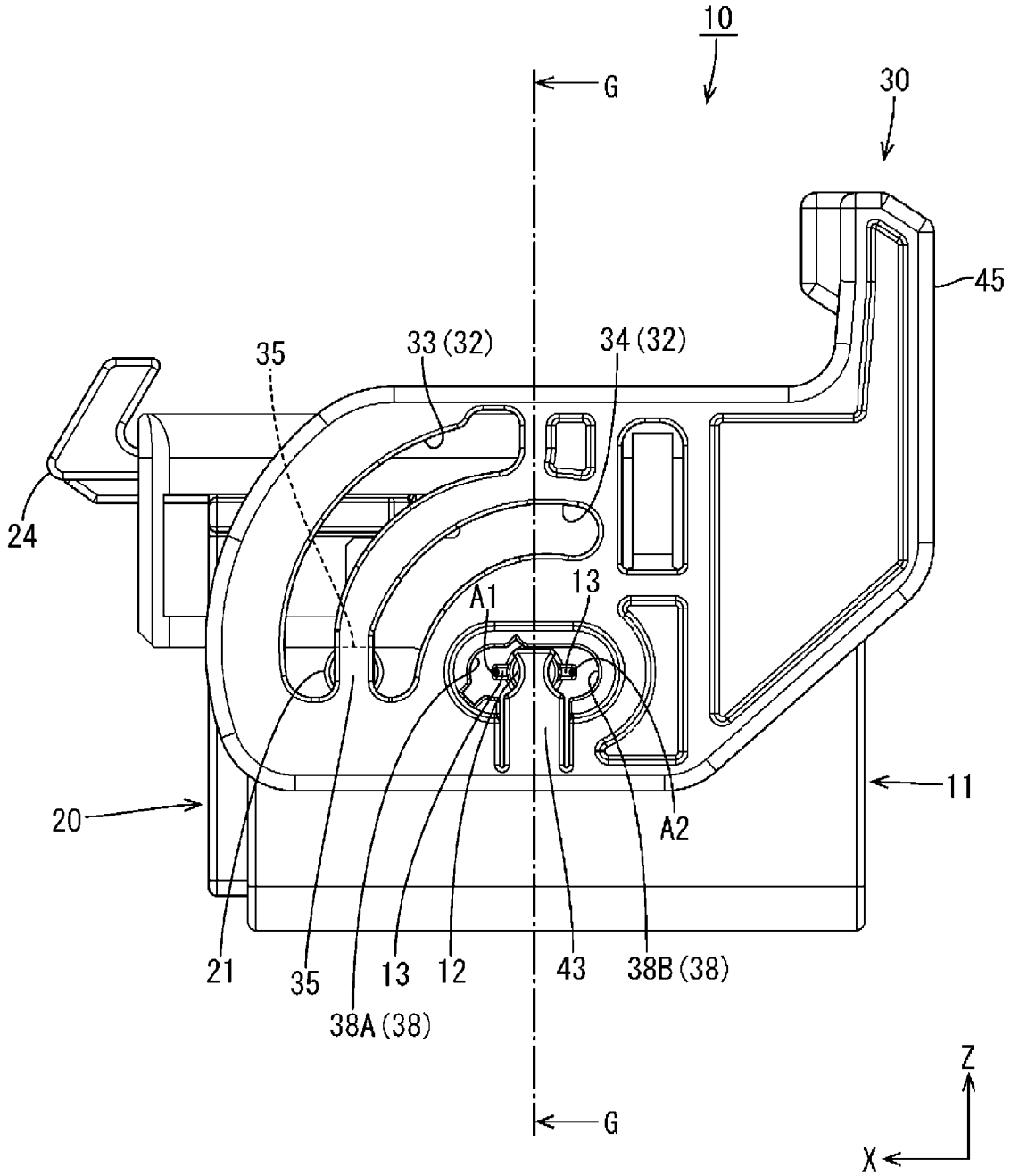
FIG. 19 is a side view showing a state where the lever is slid from a state of FIG. 17.
Figure 20:
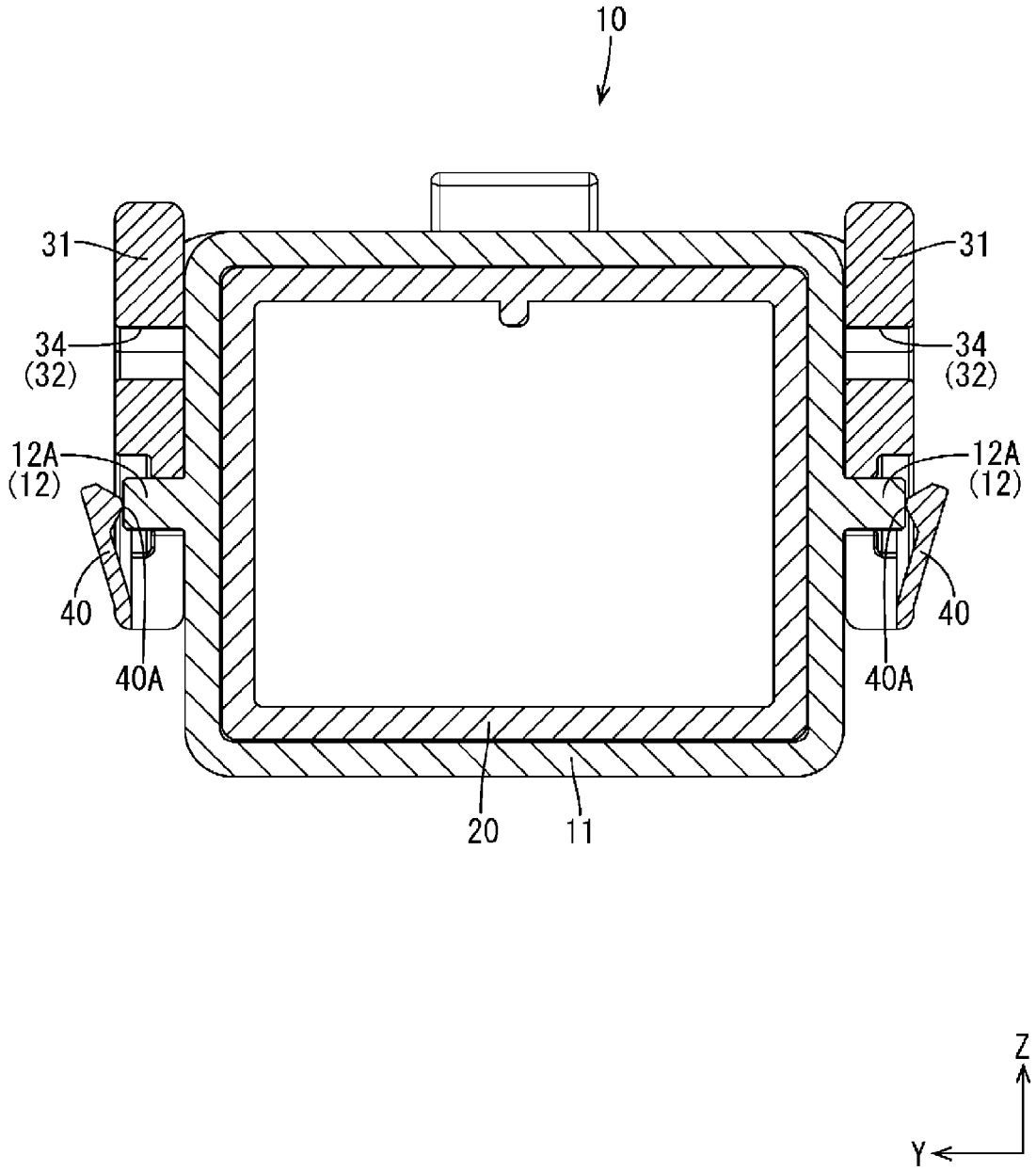
FIG. 20 is a section along G-G of FIG. 19.
Figure 21:
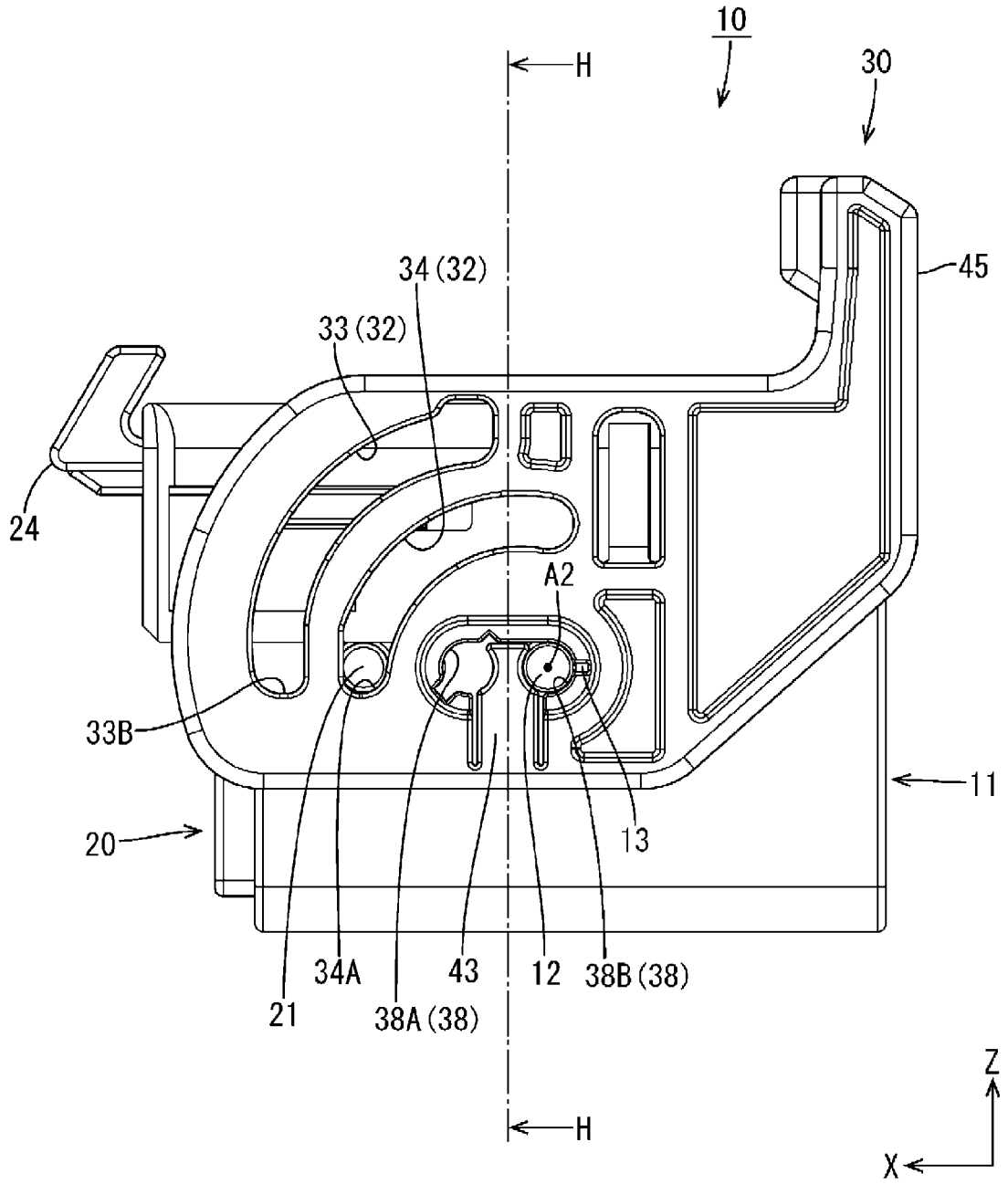
FIG. 21 is a side view showing a state where the lever is further slid from the state of FIG. 19 and a support shaft is disposed in a second shaft hole.
Figure 22:
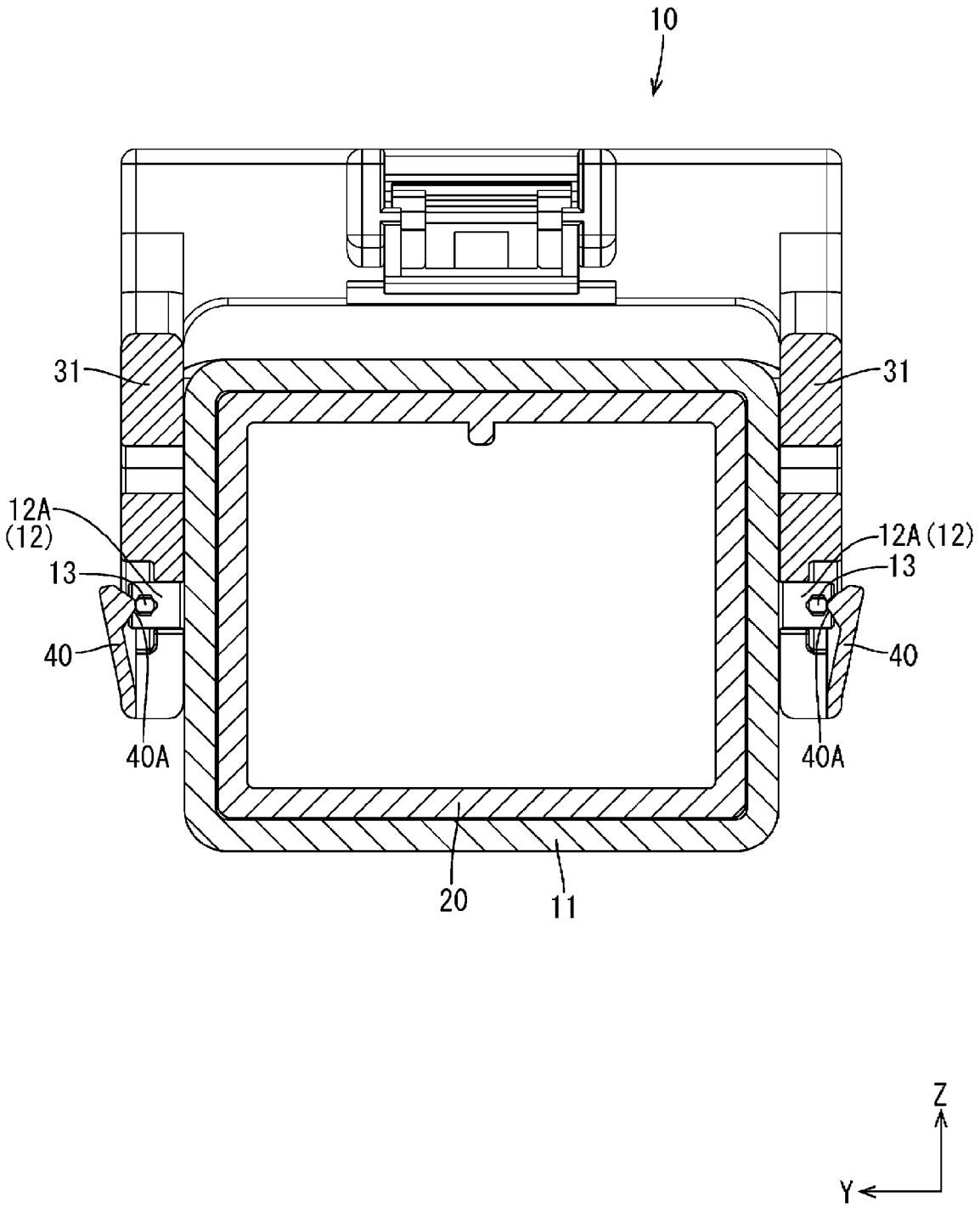
FIG. 22 is a section along H-H of FIG. 21.

Subsequently, the operator biases the lever 30 forward to slide the lever 30 forward with respect to the first and second housings 11, 20 as shown in FIG. 19. Then, the cam followers 21 are guided to the coupling grooves 35A on the back sides of the coupling portions 35 and slide rearward, the support shafts 12 slide rearward in the shaft holes 38 and, as shown in FIG. 20, the partition pieces 40 ride on the support shaft bodies 12A. If the lever 30 is slid further forward, the partition pieces 40 pass through the support shaft bodies 12A and come into contact with the contact portions 13 as shown in FIGS. 21 and 22. Further, the support shafts 12 come into contact with hole walls of the second shaft holes 38B to restrict a sliding movement of the lever 30, and the cam followers 21 are locked to groove walls of the second groove portions 34 (groove walls of the end parts 34A) and can move in the second groove portions 34.

Figure 23:
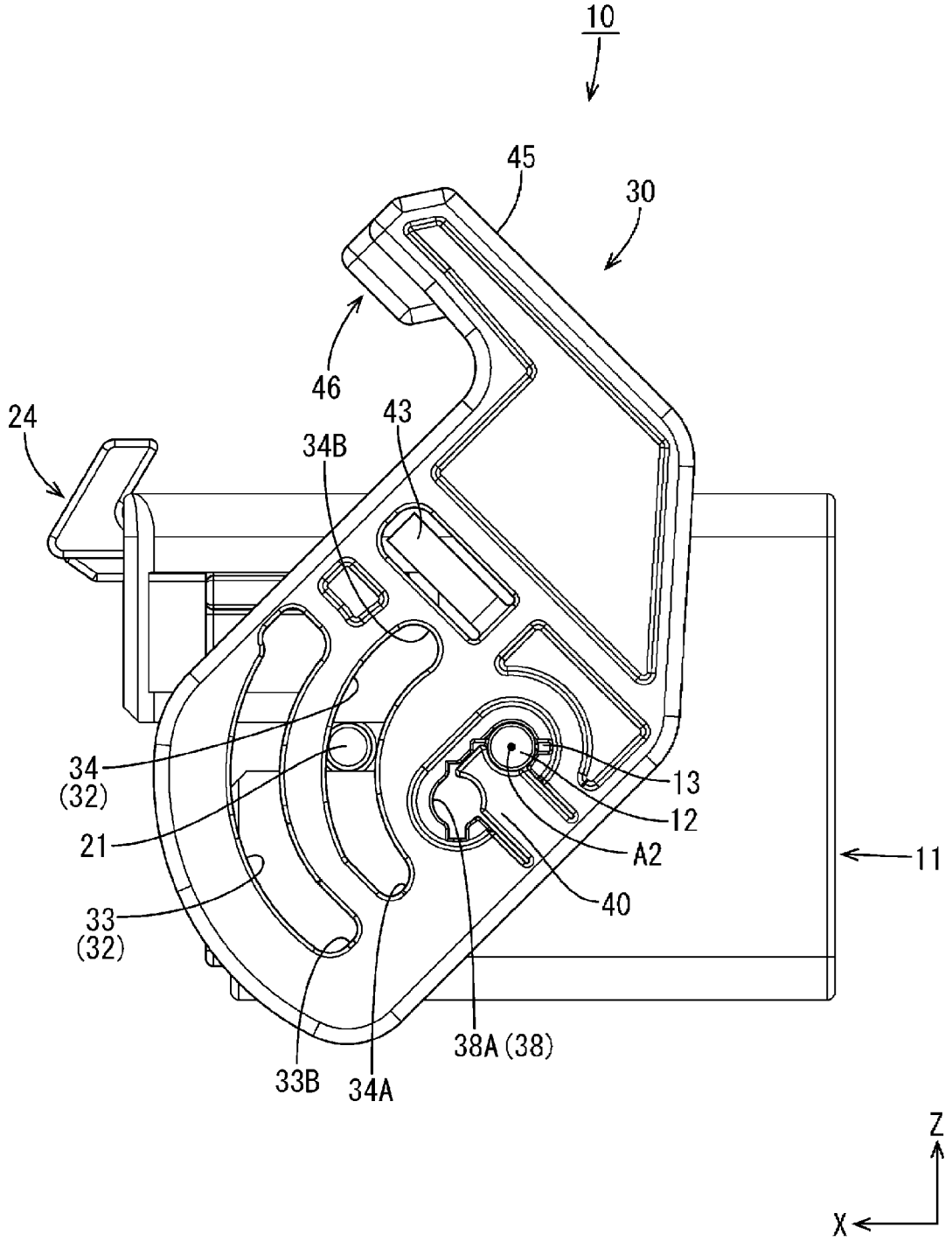
FIG. 23 is a side view of the lever-type connector showing a state where the lever is rotated 45° in a reverse rotation direction from the state of FIG. 21.

Subsequently, the lever 30 is rotated in the reverse rotation direction as shown in FIG. 23. Then, the contact portions 13 pass through the partition pieces 40 and the partition pieces 40 are restored, and the cam followers 21 move in an opposite direction in the second groove portions 34 with the support shafts 12 inserted in the second shaft holes 38B and set rotatable about the axes of rotation A2. When the cam followers 21 come into contact with the final end parts 34B of the second groove portions 34, the locking portion 46 of the coupling grip portion 45 is locked to the locking projection 25A of the lever locking portion 24 of the second housing 20 to hold the lever 30 in the locked state, and the first and second housings 11, 20 are completely connected (FIG. 1).

Functions and effects of this embodiment are described.

The lever-type connector 10 includes the first housing 11, the second housing 20 to be connected to the first housing 11, and the lever 30 for moving the second housing 20 in a connection direction to the first housing 11 by being rotated with respect to the first housing 11, the lever 30 is formed with the cam grooves 32, the second housing 20 is formed with the cam followers 21 movable along the cam grooves 32, the lever 30 is rotatable about the axes of rotation A1, A2 movable within a predetermined range with respect to the first housing 11, the cam groove 32 includes the first groove portion 33 configured to guide the cam follower 21, the second groove portion 34 disposed along the first groove portion 33 on the side of the axes of rotation A1, A2 with respect to the first groove portion 33 and configured to guide the cam follower 21, and the coupling groove 35A extending in the direction intersecting the first and second groove portions 33, 34 to couple the first and second groove portions 33, 34 and configured to guide the cam followers 21, and the coupling groove 35A extends in the direction along a moving direction of the axes of rotation A1, A2.

According to this embodiment, if the lever 30 is rotated with the cam followers 21 disposed in the first groove portions 33, the cam followers 21 are guided in the first groove portions 33. If the cam followers 21 reach positions where the first groove portions 33 and the coupling grooves 35A intersect, the first and second housings 11, 20 are partially connected. If the lever 30 is slid with respect to the first housing 11 thereafter, the axes of rotation A1, A2 of the lever 30 slide within the predetermined range, the cam followers 21 in the first groove portions 33 move to the second groove portions 34 through the coupling grooves 35A and the cam followers 21 reach positions where the coupling grooves 35A and the second groove portions 34 intersect, thereby restricting a sliding movement of the lever 30. By rotating the lever 30 toward an opposite side, the cam followers 21 in the second groove portions 34 move to the opposite sides of the second groove portions 34 and the first and second housings 11, 20 are completely connected. In this way, the lever 30 can be easily operated in completely connecting the first and second housings 11, 20 in the partially connected state.

Further, the first housing 11 is formed with the support shafts 12, which become concentric with the axes of rotation A1, A2, the lever 30 is formed with the first shaft holes 38A and the second shaft holes 38B, into which the support shafts 12 are rotatably inserted, and the partition pieces 40 (partitioning portion) partitioning between the first and second shaft holes 38A, 38B, and the partition pieces 40 are deflectable and deformable in the directions to allow movements of the support shafts 12 between the first and second shaft holes 38A, 38B.

According to this configuration, the lever 30 can be rotatably held at a predetermined position by the partition pieces 40.

The contact portions 13 for coming into contact with the partition pieces 40 to deflect and deform the partition pieces 40 by the rotation of the lever 30 project on the outer periphery of the support shaft 12.

According to this configuration, a configuration for deflecting and deforming the partition pieces 40 during the rotation of the lever 30 can be simplified.

The coupling portion 35 is provided which couples the first and second groove portions 33, 34, the first and second groove portions 33, 34 are formed to penetrate through the lever 30, and the coupling groove 35A is provided on the side of the coupling portion 35 toward the first housing 11.

According to this configuration, the strength of a region between the first and second groove portions 33, 34 can be enhanced as compared to the case where the coupling groove 35A is formed to penetrate through the lever 30.

Other Embodiments

The technique described in this specification is not limited to the above described and illustrated embodiment. For example, the following embodiments are also included in the technical scope of the technique described in this specification.

(1) Although the lever-type connector 10 includes the partition pieces 40 and the contact portions 13 of the support shafts 12, there is no limitation to this and at least either the partition pieces 40 or the contact portions 13 may not be provided.

(2) Although the coupling groove 35A is formed in the coupling portion 35, there is no limitation to this and the coupling portion 35 may not be formed. For example, a through hole allowing communication between the first and second groove portions 33, 34 may be used as a coupling groove and the cam follower 21 in the coupling groove may be exposed.

(3) Although the support shafts 12 are provided on the first housing and the shaft holes 38 into which the support shafts 12 are inserted are provided in the lever 30, there is no limitation to this and support shafts may be provided on a lever and shaft holes (first and second shaft holes) into which the support shafts are movably inserted may be provided in side surfaces of a first housing.

LIST OF REFERENCE NUMERALS

10: lever-type connector
11: first housing
12: support shaft
13: contact portion
16: cutout portion
20: second housing
21: cam follower
30: lever
32: cam groove
33: first groove portion
34: second groove portion
35: coupling portion
35A: coupling groove
38: shaft hole
40: partition piece (partitioning portion)
A1, A2: axis of rotation

What is claimed is:

1. A lever-type connector, comprising:

a first housing;

a second housing to be connected to the first housing; and a lever for moving the second housing in a connection direction to the first housing by being rotated with respect to the first housing, wherein:

the lever is formed with a cam groove and the second housing is formed with a cam follower movable along the cam groove, the lever is rotatable about an axis of rotation movable within a predetermined range with respect to the first housing, the cam groove includes a first groove portion configured to guide the cam follower, a second groove portion disposed along the first groove portion on the axis of rotation side with respect to the first groove portion and configured to guide the cam follower, and a coupling groove extending in a direction intersecting the first and second groove portions to couple the first and second groove portions and configured to guide the cam follower, and the coupling groove extends in a direction along a moving direction of the axis of rotation.

2. The lever-type connector of claim 1, comprising a coupling portion coupling the first and second groove portions, wherein:

the first and second groove portions are formed to penetrate through the lever, and the coupling groove is provided on the first housing side of the coupling portion.

3. The lever-type connector of claim 1, wherein:

the first housing is formed with a support shaft concentric with the axis of rotation, the lever is formed with a first shaft hole and a second shaft hole, the support shaft being rotatably inserted into the first and second shaft holes, and a partitioning portion partitioning between the first and second shaft holes, and the partitioning portion is deflectable and deformable in a direction to allow a movement of the support shaft between the first and second shaft holes.

4. The lever-type connector of claim 3, wherein a contact portion for coming into contact with the partitioning portion to deflect and deform the partitioning portion by rotation of the lever projects on an outer periphery of the support shaft.

* * * * *